United States Patent [19]

Sweigart et al.

[11] 4,370,593

[45] Jan. 25, 1983

[54] IN-LINE ELECTRON GUN AND METHOD FOR MODIFYING THE SAME

[75] Inventors: Raymond H. Sweigart, Lancaster; Mary E. Doersom, Ephrata, both of Pa.

[73] Assignee: RCA Corporation, New York, N.Y.

[21] Appl. No.: 221,434

[22] Filed: Dec. 30, 1980

[51] Int. Cl.[3] ..... H01J 29/50

[52] U.S. Cl. ..... 313/414; 313/409

[58] Field of Search ..... 313/409, 414

[56] References Cited

U.S. PATENT DOCUMENTS

| | | | |
|---|---|---|---|
| Re. 29,895 | 1/1979 | Murata et al. | 313/411 |
| 3,164,737 | 1/1965 | Messineo et al. . | |
| 3,196,305 | 7/1965 | Barkow . | |
| 3,534,208 | 10/1970 | Krackhardt et al. . | |
| 3,548,249 | 12/1970 | Yoshida et al. . | |
| 3,594,600 | 7/1971 | Murata et al. | 313/79 |
| 3,860,850 | 1/1975 | Takenaka et al. | 313/428 |
| 3,866,080 | 2/1975 | Barkow | 313/412 |
| 3,873,879 | 3/1975 | Hughes | 315/13 C |
| 4,142,131 | 1/1979 | Ando et al. | 315/368 |
| 4,196,370 | 4/1980 | Hughes | 313/413 |
| 4,310,780 | 1/1982 | Sakurai et al. | 313/414 |

*Primary Examiner*—Harold A. Dixon

*Attorney, Agent, or Firm*—Eugene M. Whitacre; Dennis H. Irlbeck; Vincent J. Coughlin, Jr.

[57] ABSTRACT

An in-line electron gun mount comprises a plurality of cathodes for producing and directing a plurality of electron beams along spaced co-planar paths. A shield cup having a back surface with a plurality of co-planar apertures therethrough is disposed along the beam paths. One of the apertures of the shield cup has a first pair of magnetically permeable members attached to the back surface of the shield cup. A nonmagnetic plate having a plurality of co-planar apertures therethrough has a second pair of magnetically permeable members attached to one surface thereof. The plate is attached to the back surface of the shield cup so that the second pair of members are disposed between the back surface of the shield cup and the plate. The plate apertures are substantially aligned with the shield cup apertures.

6 Claims, 5 Drawing Figures

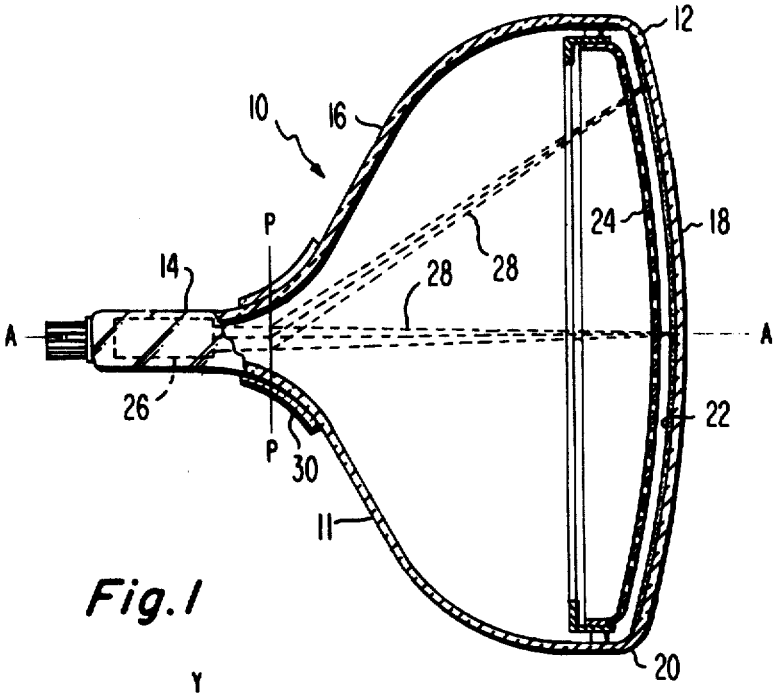
Fig. 1
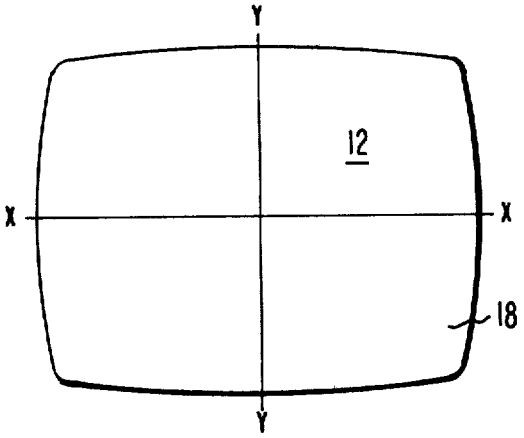
Fig. 2
Fig. 3
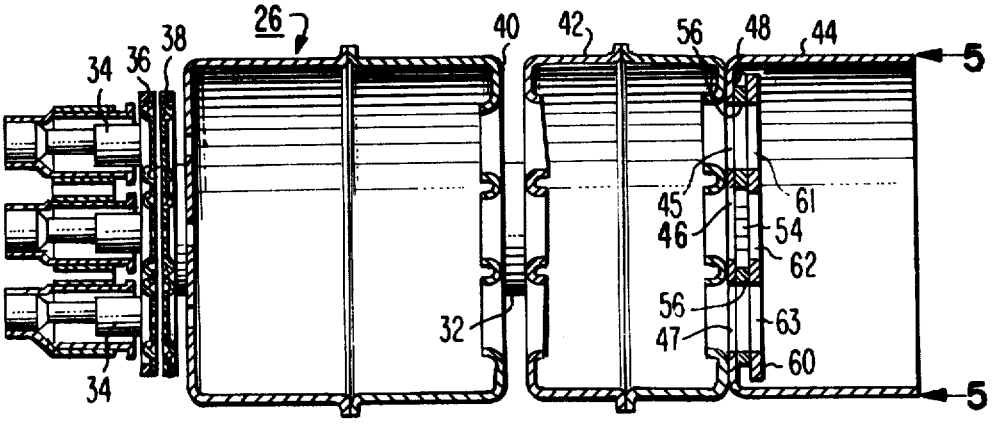

IN-LINE ELECTRON GUN AND METHOD FOR MODIFYING THE SAME

BACKGROUND OF THE INVENTION

This invention relates to an in-line electron gun for a color picture tube, and particularly to a structure and method for modifying such an in-line gun.

An in-line electron gun is one designed to generate preferably three electron beams in a common plane and direct those beams along convergent paths in that plane to a point or small area of convergence near the tube screen.

A problem that exists in a color picture tube having an in-line gun is a coma distortion wherein the sizes of the three rasters scanned by the three beams on the screen by an external magnetic deflection yoke are different because of the eccentricity of the two outer beams with respect to the center of the yoke.

A number of structures known in the art correct for coma. Messineo, et al., U.S. Pat. No. 3,164,737 issued Jan. 5, 1965, teaches that a coma distortion caused by using different beam velocities can be corrected by use of a magnetic shield around the path of one or more beams in a three gun assembly. Barkow, U.S. Pat. No. 3,196,305, issued July 20, 1965, teaches the use of magnetic enhancers adjacent to the path of one or more beams in a delta gun, for the same purposes. Krackhardt, et al., U.S. Pat. No. 3,534,208, issued Oct. 13, 1970, teaches the use of a magnetic shield around the middle one of three in-line beams for coma correction. Yoshida, et al., U.S. Pat. No. 3,548,249, issued Dec. 15, 1970, teaches the use of C-shaped elements positioned between the center and outer beams to enhance the effect of the vertical deflection field on the center beam. Murata, et al., U.S. Pat. No. 3,594,600, issued July 20, 1971, teaches the use of C-shaped shields around the outer beams with the open sides of the members facing each other. These shields appear to shunt the vertical deflection field around all three beams. Takenaka, et al., U.S. Pat. No. 3,860,850, issued Jan. 14, 1975, teaches the use of V-shaped enhancement members located above and below three in-line beams and the use of C-shaped shields around the two outer beams. Hughes, U.S. Pat. No. 3,873,879, issued Mar. 29, 1975, teaches the use of small disc-shaped enhancement elements above and below the center beam and ring-shaped shunts around the two outer beams. Ando, et al., U.S. Pat. No. 4,142,131, issued Feb. 27, 1979, teaches magnetic pole piece plates located above and below the outer beams and between the outer beams and the center beam.

The multiplicity of different coma correcting structures, some of which may be used in combination to achieve varying amounts of distortion correction, pose manufacturing problems when electron gun mounts embodying one or more coma correcting structures are overproduced. Since the required amount of the coma correction often varies from tube-type to tube-type, it is desirable to be able to modify electron guns to achieve the desired coma correcting structure for each specific tube requirement.

SUMMARY OF THE INVENTION

An in-line gun comprises first electrode means for producing and directing a plurality of electron beams along spaced co-planar paths having a common general direction. Second electrode means, spaced from the first electrode means, are disposed along the beam path for focusing the beams. A shield cup having a plurality of co-planar apertures in a back surface thereof is disposed adjacent to the second electrode means. A first pair of magnetically permeable members are attached to the back surface of the shield cup adjacent to one of the shield cup apertures. A second pair of magnetically permeable members are attached to one surface of a nonmagnetic plate having a plurality of co-planar plate apertures therethrough. The plate is attached to the back surface of the shield cup so that the second pair of members are disposed between the shield cup and the plate. The plate apertures are also substantially aligned with the shield cup apertures.

BRIEF DESCRIPTION OF THE DRAWINGS

FIG. 1 is a plan view, partially in axial section of a shadow mask color picture tube in which the present invention is incorporated.

FIG. 2 is a front end view of the tube of FIG. 1 showing the rectangular shape of the faceplate panel.

FIG. 3 is an axial section view of the electron gun shown in dashed lines in FIG. 1.

DETAILED DESCRIPTION OF THE PREFERRED EMBODIMENT

Figure 4:
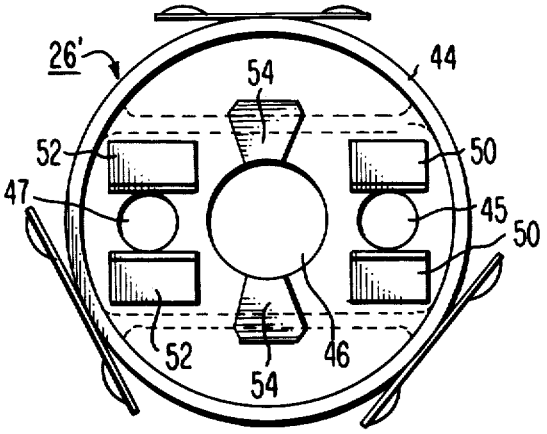
FIG. 4 is a plan view of the output end of a prior art electron gun wherein the gun includes shunts and enhancers.

FIG. 1 is a plan view of a rectangular color picture tube 10 having a glass envelope 11 comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen 22 is preferably a line screen with the phosphor lines extending substantially parallel to the minor axis Y—Y of the tube as shown in FIG. 2 (in a plane normal to the plane of FIG. 1). A multiapertured color selection electrode or shadow mask 24 is removably mounted, by conventional means, in predetermined spaced relation to the screen 22. An in-line electron gun 26, shown schematically by dashed lines in FIG. 1, is centrally mounted within the neck 14 to generate and direct three electron beams 28 along co-planar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. The yoke 30 subjects the three beams 28 to vertical and horizontal magnetic flux to scan the beams horizontally and vertically, respectively, in a rectangular raster over the screen 22. The initial plane of deflection (at zero deflection) is shown by the line P—P in FIG. 1 at about the middle of the yoke 30. Because of fringe fields, the deflection zone of the tube extends axially, from the yoke 30 into the region of the gun 26. For simplicity, the actual curvature of the deflected beam paths in the deflection zone is not shown in FIG. 1.

The details of the gun 26 are shown in FIG. 3. The gun comprises two glass support rods 32 on which the various electrodes are mounted. These electrodes include three equally spaced co-planar cathodes 34 (one for each beam), a control grid electrode 36, a screen grid electrode 38, a first accelerating and focusing electrode 40, and a second accelerating and focusing electrode 42. These electrodes and a shield cup 44, are spaced along the glass rods 32 in the order named. The control grid electrode 36, the screen grid electrode 38, the first accelerating and focusing electrode 40, the second accelerating and focusing electrode 42 and the shield cup 44 each include three co-planar apertures that circumscribe the paths of the electron beams and form focusing lens for each of the beams. Each of the aforementioned apertures is precisely formed to a close tolerance.

Two terms will be used herein to describe the function of various coma correction members used in electron guns. The term shunting refers to the bypassing of a portion of a magnetic deflection field from the path of an electron beam to reduce the deflection of the beam. The term enhancing is used to connote the concentrating of a portion of a magnetic deflection field in the path of an electron beam to increase the deflection of the beam.

In one type of in-line electron gun 26', the output end of which is shown in FIG. 4, three co-planar apertures 45, 46 and 47 are formed in the back surface 48 of the shield cup 44. The gun 26' further includes a pair of horizontally extending angle shunts 50 and 52 attached, e.g., by resistance welding, to the back surface 48 of the shield cup 44. The angle shunts are disposed adjacent to the two outside apertures 45 and 47, above and below the plane of the apertures. A pair of V-shaped magnetic enhancers 54 are also attached, e.g., by welding, to the back surface 48 of the shield cup 44 adjacent to the center aperture 46. The enhancers are disposed above and below the plane of the apertures and between the pairs of angle shunts 50 and 52. The angle shunts 50 and 52 comprise a material of high magnetic permeability, e.g., an alloy of 52 percent nickel and 48 percent iron, known as "52" metal. The enhancers 54 also comprise magnetic material, e.g., "52" metal, and enhance the magnetic flux in the middle beam in the manner well known in the art. The angle shunts and enhancers provide coma correction as described above.

In a recent production run, about 16 thousand excess guns 26', using angle shunts 50 and 52 and enhancers 54, were produced. The above-described gun structure 26', designated the RCA PI-25(N), is similar to another gun structure 26, designated the RCA PI-17(T). The structures differ only in a spacing variation between the screen grid electrode 38 and the first accelerating and focusing electrode 40, and in the design of the shunts used for coma correction.

Figure 5:
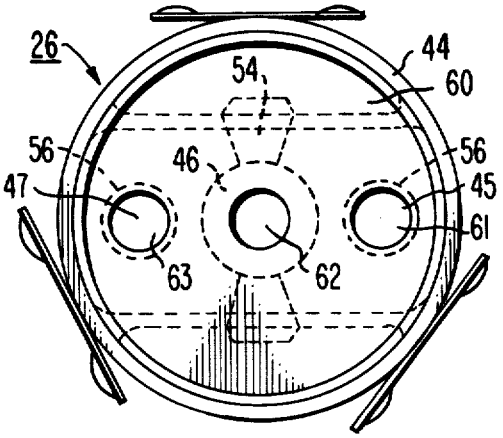
FIG. 5 is a plan view of the output end of the electron gun shown in FIG. 4 which was modified by the novel method.

The novel modifying method described herein permits substantially all the above-described guns 26' to be reworked and used for another application. The RCA PI-17(T) in-line electron gun 26, an output end view of which is shown in FIG. 5, is substantially similar to the aforedescribed gun 26', except that the spacing between the screen grid electrode 38 and the first accelerating and focusing electrode 40 is about 0.033 inches (0.838 mm) for the gun 26' and 0.048 inches (1.219 mm) for the gun 26. This difference in electrode spacing results in a slightly higher focus voltage for the gun 26; however, this difference is not significant and can be compensated for within the receiver. The gun 26 also differs in that it uses a pair of shield ring shunts 56 which concentrically surrounds each of the outer apertures 45 and 47, respectively. The shield ring shunts 56 are formed from, e.g., "52" metal and have a thickness of 0.254 mm and an inside diameter of 4.06 mm. The inside diameter of the ring shunts 56 conforms to the diameter of the top shield cup apertures 45 and 47. The shield ring shunts 56 have an outside diameter of 5.33 mm. The shield ring shunts are described in U.S. Pat. No. 3,873,879 to Hughes, cited above and incorporated herein for reference purposes. Unfortunately, it is difficult to accurately and consistently locate the shield ring shunts 56 concentrically around each of the outer shield cup apertures 45 and 47 on a completed electron gun such as that shown in FIG. 3. Accordingly, applicants have devised a shunt plate 60 of nonmagnetic material, e.g., stainless steel. The shunt plate has a thickness of about $0.25 \pm 0.013$ mm and a diameter of 21.03 to 21.08 mm which is slightly less than the diameter of the shield cup 44 and thus can be fitted within the cup. Three co-planar apertures 61, 62 and 63 are formed in the shunt plate 60. Each of the apertures 61, 62 and 63 have a diameter of $4.06 \pm 0.013$ mm. A pair of shield ring shunts 56 may be aligned concentrically with the outer apertures 61 and 63 of the shunt plate 60 and attached thereto, e.g., by resistance welding. The gun 26' may be reworked into the gun 26 by removing the pairs of angle shunts 50 and 52 from the top shield cup 44. The angle shunts 50 and 52 may be removed by grasping the upright portion of the shunt with a pair of pliers and twisting the shunt to break the resistance weld. The shunt plate 60 with the shield ring shunts 56 attached thereto, as described above, is then inserted into the shield cup 44 so that the ring shunts 56 are disposed between the shunt plate 60 and the back surface 48 of the shield cup 44. The shunt plate is oriented so that the outer apertures 61 and 63 of the shunt plate 60 are aligned with the outer apertures 45 and 47 of the shield cup 44. The shunt plate 60 is attached within the shield cup 44 by resistance welding the shunt plate to the enhancers 54 which are adjacent to the center aperture 46 of the shield cup 44. As herein described, the gun 26' may be modified and reworked to form the gun 26 with a minimum amount of time and expense.

While described as a method of modifying guns which have been overproduced by removing the shunts on the shield cup and providing different shunts applied to a shunt plate, it should be understood that the invention is not limited to such gun modification. The invention also includes gun structures, initially produced with only enhancers attached to the back surface of the shield cup, which may be tailored to current production demands by the addition of a shunt plate having the desired shunt members attached to one surface thereof.

What is claimed is:

1. An in-line electron gun comprising:

first electrode means for producing and directing a plurality of electron beams along spaced co-planar paths having a common general direction, second electrode means disposed along said beam paths and spaced from said first electrode means for focusing said beams, a shield cup disposed adjacent to said second electrode means, said shield cup having a back surface with a plurality of co-planar apertures therethrough, and a first pair of magnetically permeable members attached to said back surface of said shield cup, said first pair of magnetic members being disposed adjacent to one of said shield cup aperture, the combination with said shield cup of;

a nonmagnetic plate having a plurality of co-planar plate apertures therethrough, and a second pair of magnetically permeable members attached to one surface of said plate, said plate being attached to said back surface of said shield cup so that said second pair of members are disposed between said shield cup and said plate and whereby said plate apertures are substantially aligned with said shield cup apertures.

2. In an in-line electron gun comprising:

first electrode means for producing and directing three electron beams along spaced co-planar paths having a common general direction, second electrode means disposed along said beam paths and spaced from said first electrode means for focusing said beams, a shield cup disposed adjacent to said second electrode means, said shield cup having a back surface with three co-planar apertures therethrough, said shield cup apertures comprising a center aperture and two outer apertures, and a first pair of magnetically permeable members attached to said back surface of said shield cup, said first pair of magnetic members being disposed adjacent to said center shield cup aperture above and below said plane of said apertures, the combination with said shield cup of;

a nonmagnetic plate having three co-planar plate apertures therethrough, said plate apertures including a center plate aperture and two outer plate apertures, and a second pair of magnetically permeable members attached to one surface of said plate, said magnetically permeable members being disposed substantially about said outer plate apertures, said plate being attached to said back surface of said shield cup so that said second pair of members are disposed between said shield cup and said plate and whereby said plate apertures are substantially aligned with said shield cup apertures.

3. In a method for modifying an in-line electron gun comprising:

first electrode means for producing said directing a plurality of electron beams along spaced co-planar paths having a common general direction, second electrode means disposed along said beam paths and spaced from said first electrode means for focusing beams, and a shield cup disposed adjacent to said second electrode means, said shield cup having a back surface with a plurality of co-planar apertures therethrough, one of said aperture having a first pair of magnetically permeable members attached to said back surface adjacent to said aperture, a second pair of magnetically permeable members attached to said back surface, said second pair of members being disposed adjacent to said outer apertures, the improvement comprising the steps of:

removing said second pair of members from said back surface of said shield cup, attaching a third pair of magnetically permeable members different from said second pair of members to one surface of a nonmagnetic plate, said plate having a plurality of co-planar plate apertures therethrough, inserting said plate into said shield cup so that said third pair of members are disposed between said back surface of said shield cup and said plate, said outer plate apertures being substantially aligned with said outer shield cup apertures, and fixedly attaching said plate to said shield cup.

4. In a method for modifying an in-line electron gun comprising:

first electrode means for producing and directing three electron beams along spaced co-planar paths having a common general direction, second electrode means disposed along said beam paths and spaced from said first electrode means for focusing said beams, and a shield cup disposed adjacent to said second electrode means, said shield cup having a back surface with three co-planar apertures therethrough, said shield cup apertures comprising a center aperture and two outer apertures, said center aperture having a first pair of magnetically permeable members attached to said back surface adjacent to said center aperture, said first pair of members being disposed above and below said plane of said apertures, said outer apertures having a second pair of magnetically permeable members attached to said back surface, said second pair of members being disposed adjacent to said outer apertures, the improvement comprising the steps of:

removing said second pair of members from said back surface of said shield cup, attaching a third pair of magnetically permeable members different from said second pair of members to one surface of a nonmagnetic plate, said plate having three co-planar plate apertures therethrough, said plate apertures including a center plate aperture and two outer plate apertures, inserting said plate into said shield cup so that said third pair of members are disposed between said back surface of said shield cup and said plate, said outer plate apertures being substantially aligned with said outer shield cup apertures, and fixedly attaching said plate to said shield cup.

5. The method as in claim 4 wherein said third pair of members are substantially concentrically disposed about said outer plate apertures.

6. The method as in claim 5 wherein said plate is fixedly attached to said shield cup by welding said plate to said first pair of members.

* * * * *